US007395880B1

(12) United States Patent
Esquivel

(10) Patent No.: US 7,395,880 B1
(45) Date of Patent: Jul. 8, 2008

(54) MORTAR REMOVAL DRILL BIT SYSTEM

(76) Inventor: Bob M. Esquivel, 229 W. Gant St., Princeton, TX (US) 75407

( * ) Notice: Subject to any disclaimer, the term of this patent is extended or adjusted under 35 U.S.C. 154(b) by 336 days.

(21) Appl. No.: 11/198,531

(22) Filed: Aug. 8, 2005

(51) Int. Cl.
*E21B 10/43* (2006.01)
*E21B 10/22* (2006.01)

(52) U.S. Cl. ..... 175/323; 175/394; 175/434

(58) Field of Classification Search ..... 175/323, 175/394, 434
See application file for complete search history.

(56) References Cited

U.S. PATENT DOCUMENTS

| | | | | | |
|---|---|---|---|---|---|
| 2,714,500 | A | * | 8/1955 | Snyder | 175/323 |
| 2,830,795 | A | * | 4/1958 | Center, Jr. | 175/379 |
| 3,645,587 | A | * | 2/1972 | Parker | 175/325.1 |
| 3,709,308 | A | | 1/1973 | Rowley et al. | |
| 3,978,933 | A | * | 9/1976 | Olson et al. | 175/325.2 |
| 4,176,723 | A | | 12/1979 | Arceneaux | |
| 4,285,407 | A | * | 8/1981 | Samford | 175/323 |
| 4,550,790 | A | | 11/1985 | Link | |
| 5,020,394 | A | | 6/1991 | Nakamura et al. | |
| 5,592,996 | A | | 1/1997 | Keith | |
| 5,641,027 | A | * | 6/1997 | Foster | 175/107 |
| D390,239 | S | | 2/1998 | Malin | |
| 6,474,423 | B1 | * | 11/2002 | Wood | 175/323 |
| 6,668,945 | B2 | * | 12/2003 | Ohmer | 175/61 |
| 2007/0000700 | A1 | * | 1/2007 | Switzer | 175/394 |

FOREIGN PATENT DOCUMENTS

| | | | |
|---|---|---|---|
| GB | 2167005 | * | 5/1986 |
| GB | 2214861 | * | 9/1989 |

* cited by examiner

*Primary Examiner*—Hoang Dang

(57) ABSTRACT

A mortar removal drill bit system includes a toothed drill bit that includes an elongated rod that has a first end and a second end. A plurality of rectangular plates is attached to and extends laterally from the rod. Each of the plates has a distal edge with respect to the rod. Each of the distal edges is orientated parallel to a longitudinal axis of the rod. The first end of the rod is removably extendable into and attached to a drill.

8 Claims, 3 Drawing Sheets

MORTAR REMOVAL DRILL BIT SYSTEM

BACKGROUND OF THE INVENTION

1. Field of the Invention

The present invention relates to drill bit devices and more particularly pertains to a new drill bit device for aiding a person in the removal of mortar positioned around bricks and stones.

2. Description of the Prior Art

The use of drill bit devices is known in the prior art. U.S. Pat. No. 3,709,308 describes a diamond drill bit device for use in a plurality of drilling situations and in particular for mining purposes. Another type of drill bit device is shown in U.S. Pat. No. 5,592,996. Yet another drill bit is found in U.S. Pat. Des. No. 390,239.

While these devices fulfill their respective, particular objectives and requirements, the need remains for one or more drill bits that are configured for removing mortar from between bricks and stones.

SUMMARY OF THE INVENTION

The present invention meets the needs presented above by generally comprising a toothed drill bit that includes an elongated rod that has a first end and a second end. A plurality of rectangular plates is attached to and extends laterally from the rod. Each of the plates has a distal edge with respect to the rod. Each of the distal edges is orientated parallel to a longitudinal axis of the rod. The first end of the rod is removably extendable into and attached to a drill.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
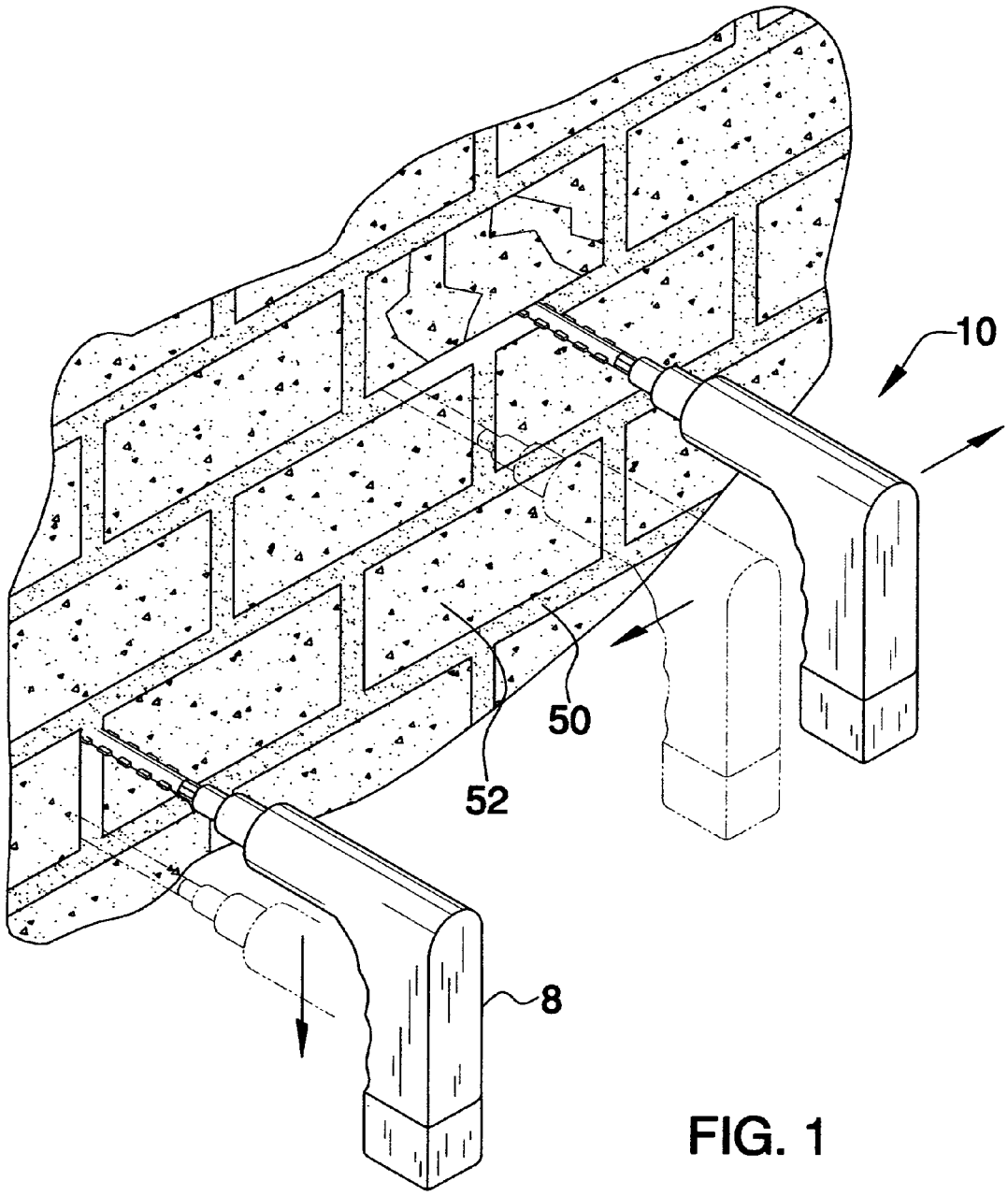
FIG. 1 is an in-use view of a mortar removal drill bit system according to the present invention.
Figure 2:
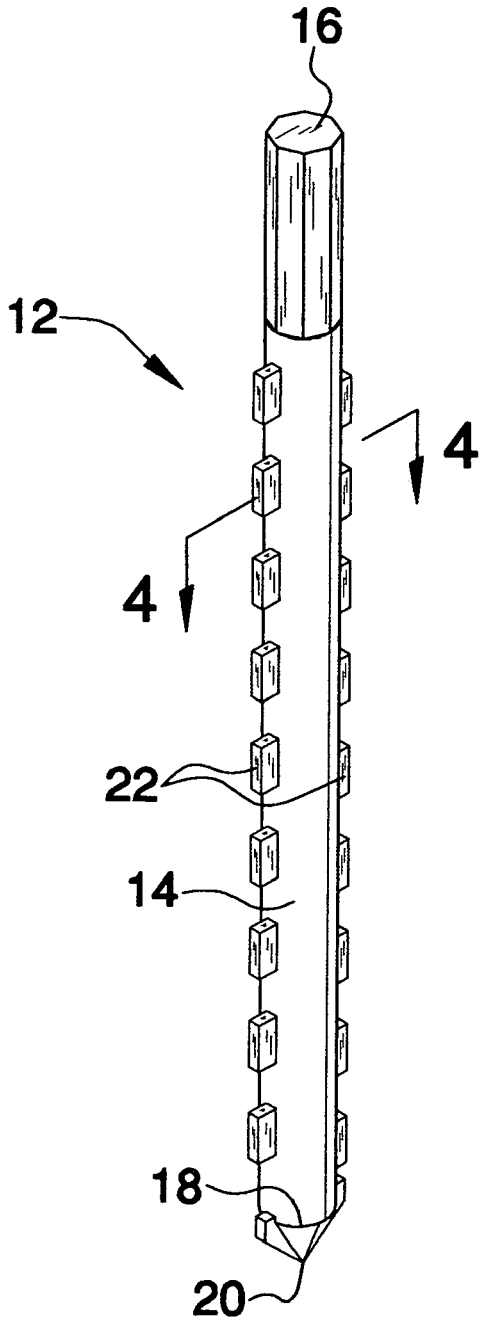
FIG. 2 is a perspective view of a first drill bit of the present invention.
Figure 3:
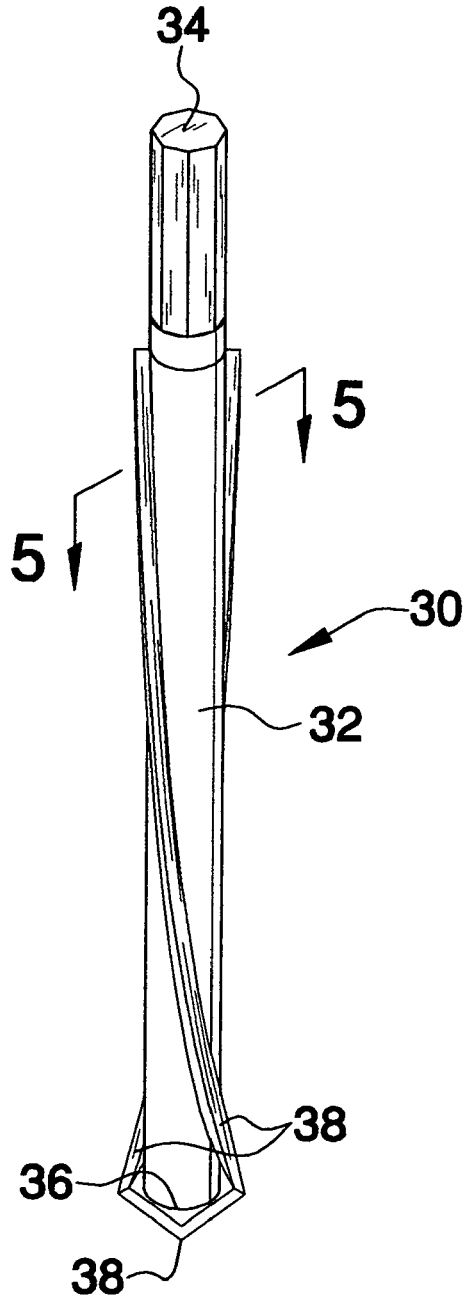
FIG. 3 is a perspective view of a second drill bit of the present invention.
Figure 4:
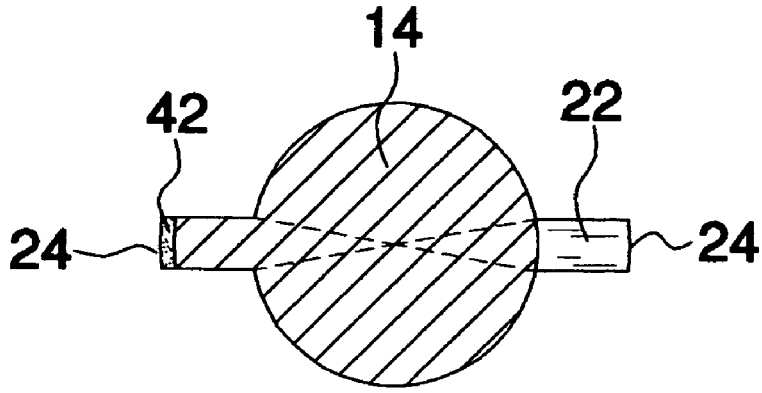
FIG. 4 is a cross-sectional view taken along line 4-4 of FIG. 2 of the present invention.
Figure 5:
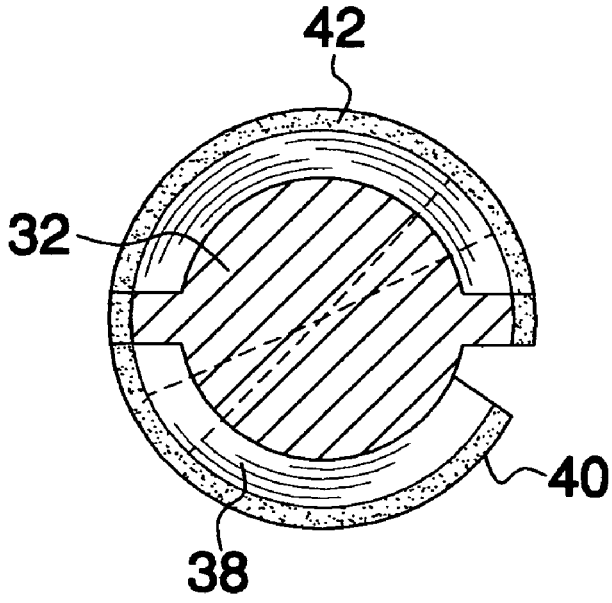
FIG. 5 is a cross-sectional view taken along line 5-5 of FIG. 3 of the present invention.

With reference now to the drawings, and in particular to FIGS. 1 through 5 thereof, a new drill bit device embodying the principles and concepts of the present invention and generally designated by the reference numeral 10 will be described.

As best illustrated in FIGS. 1 through 5, the mortar removal drill bit system 10 generally comprises a toothed drill bit 12 that includes a rod 14 that is elongated and has a first end 16 and a second end 18. The second end 18 of the rod 14 has a pointed tip 20 attached thereto that is comprised preferably of a carbide material. A plurality of rectangular plates 22 is attached to and extends laterally from the rod 14. Each of the plates 22 has a distal edge 24 with respect to the rod 14 and each of the distal edges 24 are orientated parallel to a longitudinal axis of the rod 14. The plates 22 are aligned in a plurality of rows extending between the first 16 and second 18 ends of the rod 14. The plurality of rows includes a first row and a second row. The first row of the plates 22 extends outwardly from the rod 14 in an opposite direction with the plates 22 in the second row. The plates 22 in the first row are staggered with respect to the plates 22 in the second row. The first end of the rod 14 is removably extendable into and attached to a drill, and in particular an electric hand drill 8.

A bladed drill bit 30 includes a solid shaft 32 that has a first end 34 and a second end 36. The second end 36 of the shaft 32 has a pointed tip attached thereto that is again preferably comprised of a carbide material. A plurality of blades 38 is attached to the shaft 32. Each of the blades 38 extends from the second end 36 and toward the first end 34. The blades 38 each curl partially around the shaft 32 and have a helical shape. Each of the blades 38 has an outer edge 40 with respect to the shaft 32. The outer edge 40 is pointed. The plurality of blades 38 includes two blades positioned opposite with respect to each other on the shaft. The first end 34 of the shaft is removably extendable into and attached to a drill 8. Each of the plates 22 and the blades 38 include a plurality of diamond portions 40 embedded therein to provide additional cutting strength to the blades 38 and plates 22.

In use, each of the drill bits 12, 30 is used for removing mortar 50 from around stones and bricks 52. The pointed ends 20, 38 are extended into the mortar 50 and the drill bits 12, 30 are then moved along the mortar 50 as shown in FIG. 1. This aids a person in removing the bricks 52 or stones being held in place by the mortar 50. The shape and positioning of the plates 22 and the blades 38 allows for movement in lateral and vertical directions along the troughs of mortar 50.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mortar removal drill bit system comprising:

a toothed drill bit including a rod that is elongated and has a first end and a second end, a plurality of rectangular plates being attached to and extending laterally from said rod, each of said plates having a distal edge with respect to said rod, each of said distal edges being orientated parallel to a longitudinal axis of said rod, said first end of said rod being removably extendable into and attached to a drill, said plates being aligned in a plurality of rows extending between said first and second ends of said rod; and a plurality of diamond portions being embedded in said plates.

2. The system according to claim 1, wherein said second end of said rod has a pointed tip attached thereto.

3. The system according to claim 1, wherein said plurality of rows includes a first row and a second row, said first row of said plates extending outwardly from said rod in an opposite direction with said plates in said second row.

4. The system according to claim 3, wherein said plates in said first row are staggered with respect to said plates in said second row.

5. The system according to claim 1, further including a bladed drill bit including a solid shaft having a first end and a second end, a plurality of blades being attached to said shaft, each of said blades extending from said second end and toward said first end, each of said blades curling partially around said shaft and having a helical shape, said first end of said shaft being removably extendable into and attached to a drill, a plurality of diamond portions being embedded in said blades.

6. The system according to claim 5, wherein each of said blades has an outer edge with respect to said shaft, said outer edge being pointed.

7. The system according to claim 6, wherein said plurality of blades includes two blades positioned opposite with respect to each other on said shaft.

8. A mortar removal drill bit system comprising:

a toothed drill bit including a rod that is elongated and has a first end and a second end, said second end of said rod having a pointed tip attached thereto, a plurality of rectangular plates being attached to and extending laterally from said rod, each of said plates having a distal edge with respect to said rod, each of said distal edges being orientated parallel to a longitudinal axis of said rod, said plates being aligned in a plurality of rows extending between said first and second ends of said rod, said plurality of rows including a first row and a second row, said first row of said plates extending outwardly from said rod in an opposite direction with said plates in said second row, said plates in said first row being staggered with respect to said plates in said second row, said first end of said rod being removably extendable into and attached to a drill;

a plurality of diamond portions being embedded in said plates;

a bladed drill bit including a solid shaft having a first end and a second end, said second end of said shaft having a pointed tip attached thereto, a plurality of blades being attached to said shaft, each of said blades extending from said second end and toward said first end, each of said blades curling partially around said shaft and having a helical shape, each of said blades having an outer edge with respect to said shaft, said outer edge being pointed, said plurality of blades including two blades positioned opposite with respect to each other on said shaft, said first end of said shaft being removably extendable into and attached to a drill; and a plurality of diamond portions being embedded in said blades.

* * * * *